US011705250B2

(12) United States Patent
McCall et al.

(10) Patent No.: US 11,705,250 B2
(45) Date of Patent: Jul. 18, 2023

(54) HIGH Z PERMANENT MAGNETS FOR RADIATION SHIELDING

(71) Applicants: Lawrence Livermore National Security, LLC, Livermore, CA (US); American Ceramic Technology, Poway, CA (US)

(72) Inventors: Scott McCall, Livermore, CA (US); Richard Culbertson, Poway, CA (US)

(73) Assignees: Lawrence Livermore National Security, LLC, Livermore, CA (US); American Ceramic Technology, Poway, CA (US)

( * ) Notice: Subject to any disclaimer, the term of this patent is extended or adjusted under 35 U.S.C. 154(b) by 53 days.

(21) Appl. No.: 17/112,726

(22) Filed: Dec. 4, 2020

(65) Prior Publication Data

US 2021/0174979 A1 Jun. 10, 2021

Related U.S. Application Data

(60) Provisional application No. 62/944,252, filed on Dec. 5, 2019.

(51) Int. Cl.
*G21F 1/08* (2006.01)
*C22C 30/00* (2006.01)
(Continued)

(52) U.S. Cl.
CPC ..... *G21F 1/085* (2013.01); *C22C 27/04* (2013.01); *C22C 30/00* (2013.01); *G21F 1/125* (2013.01);
(Continued)

(58) Field of Classification Search
None
See application file for complete search history.

(56) References Cited

U.S. PATENT DOCUMENTS 9,666,317 B2 5/2017 Culbertson et al.
2015/0287486 A1* 10/2015 Culbertson ..... G21F 1/103 250/517.1
(Continued)

FOREIGN PATENT DOCUMENTS

WO WO-2015169712 A1 * 11/2015 ..... B22F 1/0003

OTHER PUBLICATIONS

Cui et al., "Development of MnBi permanent magnet: Neutron diffraction of MnBi powder," Journal of Applied Physics, vol. 115, Mar. 5, 2014, 4 pages.
(Continued)

*Primary Examiner* — Xiaobei Wang
(74) *Attorney, Agent, or Firm* — Zilka-Kotab, P.C.

(57) ABSTRACT

A magnetic shielding material includes a material comprising manganese bismuth (MnBi) and tungsten (W), where a ratio of MnBi:W is in a range of 50:50 to about 70:30. A
(Continued)

radiation shielding product includes a part including manganese bismuth (MnBi) and tungsten (W), and a plurality of layers having a defined thickness in a z-direction, wherein each layer extends along an x-y plane perpendicular to the z-direction. At least some of the plurality of layers form a functional gradient in the z-direction and/or along the x-y plane, and the functional gradient is defined by a first layer comprising a ratio of MnBi:W being less than 100:0 and an nth layer above the first layer comprising a ratio of MnBi:W greater than 0:100.

20 Claims, 4 Drawing Sheets

(51) Int. Cl.

| | |
|---|---|
| ***H01F 1/055*** | (2006.01) |
| ***G21F 1/12*** | (2006.01) |
| ***H01F 27/36*** | (2006.01) |
| ***C22C 27/04*** | (2006.01) |

(52) U.S. Cl.
CPC ..... *H01F 1/055* (2013.01); *H01F 27/366* (2020.08); *C22C 2202/02* (2013.01)

(56) References Cited

U.S. PATENT DOCUMENTS

2016/0322134 A1* 11/2016 Kim ..... H01F 1/047
2017/0184975 A1* 6/2017 Nikipelov ..... H01F 7/0273

OTHER PUBLICATIONS

Kim et al., "Magnetic properties of large-scaled MnBi bulk magnets," Journal of Alloys and Compounds, vol. 708, 2017, pp. 1245-1249.
Wikipedia, "Half-value layer," Wikipedia, 2020, 2 pages, retrieved from https://en.wikipedia.org/wiki/Half-value_layer.
Wikipedia, "Radiation protection," Wikipedia, 2020, 16 pages, retrieved from https://en.wikipedia.org/wiki/Radiation_protection.
Nuclear Power, "Shielding of Gamma Radiation," Nuclear Power, 2020, 11 pages, retrieved from https://www.nuclear-power.net/nuclear-power/reactor-physics/atomic-nuclear-physics/radiation/shielding-of-ionizing-radiation/shielding-gamma-radiation/.
Wikipedia, "Tungsten," Wikipedia, 2020, 20 pages, retrieved from https://en.wikipedia.org/wiki/Tungsten.
Wikipedia, "Neutron," Wikipedia, 2020, 26 pages, retrieved from https://en.wikipedia.org/wiki/Neutron.
Wikipedia, "Gamma ray," Wikipedia, 2020, 17 pages, retrieved from https://en.wikipedia.org/wiki/Gamma_ray.

* cited by examiner

HIGH Z PERMANENT MAGNETS FOR RADIATION SHIELDING

RELATED APPLICATIONS

This application claims priority to Provisional U.S. Appl. No. 62/944,252 filed on Dec. 5, 2019, which is herein incorporated by reference.

FIELD OF THE INVENTION

The present invention relates to radiation shielding, and more particularly, this invention relates to high Z permanent magnets for radiation shielding.

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND

Radiation shielding is an essential component for performing work and maintenance in nuclear power plants, laboratories performing work on radioactive materials, and around high energy accelerators and synchrotrons to ensure that exposure is maintained to ALARA (as low as reasonably achievable) standards. Portable radiation shielding is attached to pipes and surfaces to rapidly reduce dose-rates (gamma, neutrons) in environments such as nuclear power plants. For some applications, permanent magnets within the shielding make it easier to install onto steel pipes and walls. For many applications, shielding needs to be attached to pipes and surfaces which are ferrous and permanent magnets enable an effective and reliable way to deploy and remove such shielding. In the case of non-magnetic steels and other materials, magnetic shielding may be wrapped around the pipe and adhere to itself.

American Ceramic Technology, Inc. is a leader in radiation shielding, specifically the Silflex® Premium Magnetic radiation shielding which is designed for use with steel pipes and surfaces to rapidly reduce dose-rates (primarily gamma, neutrons). The magnetic material of the ACT radiation shielding provides easy-to-install and easy-to-maintain shielding that is held in place by the magnetic properties of the shielding material. The ACT product includes tungsten containing silicone radiation shielding material loaded with $Nd_2Fe_{14}B$ (Nd—Fe—B) powder which is a high-performance magnet and provides the relevant magnetic contributions. However, these materials are only useful to about 100° C., above which the magnetic properties of the material begins to significantly decrease.

It would be desirable to use a more robust magnet composite that could maintain coercivity above 100° C. and, if possible, be less expensive than known standard NdFeB which contains the rare and increasingly expensive neodymium (Nd) element.

SUMMARY

In one embodiment, a magnetic shielding material includes a material comprising manganese bismuth (MnBi) and tungsten (W), where a ratio of MnBi:W is in a range of 50:50 to about 70:30.

In another embodiment, a radiation shielding product includes a part including manganese bismuth (MnBi) and tungsten (W), and a plurality of layers having a defined thickness in a z-direction, wherein each layer extends along an x-y plane perpendicular to the z-direction. At least some of the plurality of layers form a functional gradient in the z-direction and/or along the x-y plane, and the functional gradient is defined by a first layer comprising a ratio of MnBi:W being less than 100:0 and an nth layer above the first layer comprising a ratio of MnBi:W greater than 0:100.

Other aspects and advantages of the present invention will become apparent from the following detailed description, which, when taken in conjunction with the drawings, illustrate by way of example the principles of the invention.

DETAILED DESCRIPTION

Figure 1A:
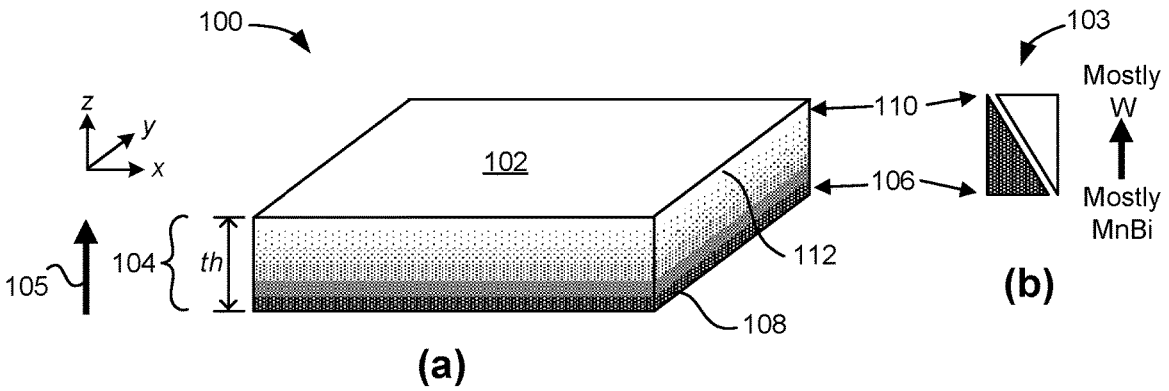
FIG. 1A is a schematic drawing of a magnetic shielding material, according to one embodiment. Part (a) is a three dimensional perspective of the magnet structure, and part (b) is a diagram of a concentration profile of the compositional components of the magnet, according to one approach.
Figure 1B:
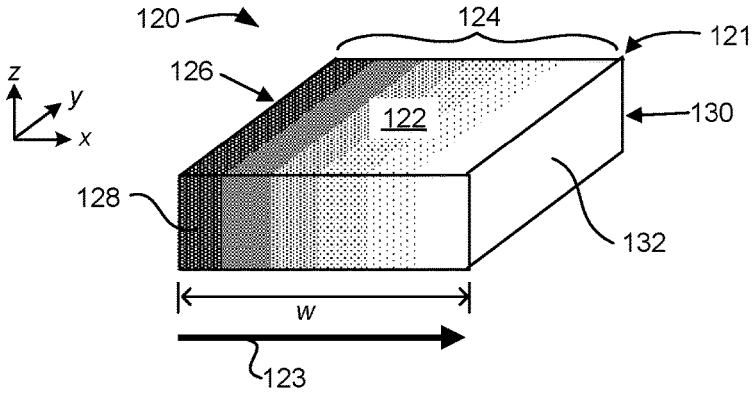
FIG. 1B is a schematic drawing of a magnetic shielding material having a compositional gradient in the x-direction perpendicular to the z-direction, according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

As also used herein, the term "about" denotes an interval of accuracy that ensures the technical effect of the feature in question. In various approaches, the term "about" when combined with a value, refers to plus and minus 10% of the reference value. For example, a thickness of about 10 nm refers to a thickness of 10 nm±1 nm, a temperature of about 50° C. refers to a temperature of 50° C.±5° C., etc.

The following description discloses several preferred embodiments of high Z permanent magnets for radiation shielding and/or related systems and methods.

In one general embodiment, a magnetic shielding material includes a material comprising manganese bismuth (MnBi) and tungsten (W), where a ratio of MnBi:W is in a range of 50:50 to about 70:30.

In another general embodiment, a radiation shielding product includes a part including manganese bismuth (MnBi) and tungsten (W), and a plurality of layers having a defined thickness in a z-direction, wherein each layer extends along an x-y plane perpendicular to the z-direction. At least some of the plurality of layers form a functional gradient in the z-direction and/or along the x-y plane, and the functional gradient is defined by a first layer comprising a ratio of MnBi:W being less than 100:0 and an nth layer above the first layer comprising a ratio of MnBi:W greater than 0:100.

The effectiveness of radiation shielding depends on the type of radiation and its energy, the type of shielding, and the thickness of the shielding material. In most applications, radiation shielding is used to block radiation from gamma rays and neutrons. Gamma rays are a penetrating form of electromagnetic radiation arising from the radioactive decay of atomic nuclei. Gamma rays generally have the shortest wavelength in the electromagnetic spectrum and impart the highest photon energy. Neutrons are a form of ionizing radiation that may be emitted from nuclear fusion, nuclear fission, radioactive decay, interaction with particles, etc.

Radiation shielding (e.g., in terms of blocking incoming gamma rays) can be designed in terms of the type of material and the thickness of the material to reduce the intensity of radiation. The effectiveness of the shielding material typically increases with its atomic number, denoted by Z. Elements with a higher Z (atomic number) are generally good candidates for shielding material. For example, high-Z elements used in shielding include lead (Pb, Z=82), tantalum (Ta, Z=73), bismuth (Bi, Z=83), tungsten (W, Z=74), etc.

An effectiveness thickness of the shielding material may be determined by calculating the material's half-value layer which is defined as the thickness of the material at which the intensity of radiation passing through it is reduced by half. The half-value layer (i.e., half-value thickness) typically decreases as the atomic number (Z) of the absorber increases and the density of the material increases. For example, against a 100 keV gamma ray beam, 37 meters of air is needed to reduce the intensity of the gamma ray by half, whereas the only 0.12 millimeters of lead is needed to reduce the intensity to the same extent. Moreover, for bismuth, having a Z similar to lead, but slightly lower density, about 0.13 mm is needed to reduce the intensity of the gamma ray beam to the same extent.

Radiation shielding in nuclear power plants typically involves wrapping the high Z material around the pipes and parts of the plant to shield from the gamma radiation. However, installing and maintaining shields around the pipes and parts tends to be inefficient, difficult to install, and difficult to maintain. Recently, approaches to radiation shielding have included adding permanent magnets to traditional radiation shield material to secure the shield to a structure by using the magnetic properties of the shield. Certain aspects of the methodology as disclosed by the inventors for forming a magnetic radiation shield is disclosed in U.S. Pat. No. 9,666,317 which is herein incorporated by reference.

These products include neodymium-based magnets combined with radiation shielding material. However, the demand for high performance permanent magnets, in particular permanent magnets containing neodymium, is increasing as the market for permanent magnet-based high performance compact motors is rapidly expanding for applications such as hybrid electric vehicles, all electric vehicles, and cordless power tools. With rising demand, the cost of neodymium permanent magnets is expected to increase substantially. It is highly desirable to incorporate an alternative magnetic material to NdFeB to lower costs of high performance permanent magnets and increase radiation shielding effectivity.

The following description discloses several preferred embodiments of high Z permanent magnets for radiation shielding and/or related systems and methods.

According to various embodiments described herein, current rare-earth element magnets may be replaced with magnets based on manganese bismuth (MnBi), a high Z permanent magnet material that offers the potential to produce improved shielding while reducing dependence on expensive rare earth elements (e.g., neodymium).

MnBi is a ferromagnet, a compound in which the bismuth (Bi) provides a structure and the manganese (Mn) provides the magnetic moment. Bismuth with its high Z value of 83 may be useful for including in radiation shielding curtains. In various approaches, a radiation shielding material (e.g., a curtain) that including MnBi magnet material, less additional high-Z materials may be needed for the same extent of shielding. In various approaches, including the magnetic material MnBi provides advantages as a radiation shield material for two purposes: the magnetic properties of Mn for securing a radiation shield to a structure, and the high-Z value of Bi for gamma radiation shielding.

Tungsten (W) is a high Z element (atomic number 74) having high density and has less toxicity to other high elements, for example, W is significantly less toxic than lead (Pb). The density of tungsten (e.g., 19.3 g/cm$^3$) is comparable to uranium and gold and is nearly twice as dense as lead (Pb). Thus, tungsten has properties of a radiation shielding material.

As described herein, MnBi may be a substitute material for conventional neodymium iron boron (NdFeB) material in select applications. Moreover, replacement with MnBi or a related high-Z rich permanent magnet has the potential to reduce demand for neodymium material. In one approach, a portion of the NdFeB portion of the radiation shield may be replaced with MnBi.

Each of FIGS. 1A-1C and FIGS. 2A-2B depicts a magnetic shielding material 100, 120, 150, 200, and 250, respectively, for a magnet having radiation shielding properties, in accordance with various embodiments. As an option, each present magnetic shielding material 100, 120, 150, 200, or 250 may be implemented in conjunction with features from any other embodiment listed herein, such as those described with reference to the other FIGS. Of course, however, each magnetic shielding material 100, 120, 150, 200, 250 and others presented herein may be used in various applications and/or in permutations which may or may not be specifically described in the illustrative embodiments listed herein. Further, each magnetic shielding material 100, 120, 150, 200, and 250 presented herein may be used in any desired environment.

According to one embodiment as illustrated in FIG. 1A, a magnetic shielding material 100 includes a material 102 including manganese bismuth (MnBi) and tungsten (W). The MnBi provides magnetic properties and radiation shielding properties of the magnetic shielding material. The high density of the tungsten (W) provides improved radiation shielding properties. The ratio of MnBi:W in the material 102 may be in a range of 50:50 to 70:30.

In one approach, the magnetic shielding material may include at least one additional material combined with the material of the magnetic shielding material. In one approach, the combination of different materials may be as a mixture (e.g., an alloy, formation of a ceramic, etc.). In another approach, the combination of different materials may be configured to be layers of each material in adjacent portions to form a single structure.

In preferred approaches, the at least one additional material is a high Z-material for optimizing radiation shielding against radiation energy such as gamma rays, neutrons, etc. In various approaches, the at least one additional material is preferably: NdFeB, tantalum (Ta), lead (Pb), boron carbide, lithium, lithium compounds, iron, stainless steel, etc.

In one approach, the additional material may be a samarium cobalt alloy, for example, $SmCo_5$ and/or $Sm_2Co_{17}$, and any various additions to the base formula $SmCo_5$. In various approaches, a magnetic shielding material including samarium cobalt alloys may provide radiation shielding to neutron radiation. Samarium cobalt alloy material is a very strong neutron absorbing material. In one approach, an amount of samarium cobalt alloy material may be in a range of greater than 0 weight % (wt. %) to about 5 wt. % of total weight of magnetic shielding material.

In various approaches, a magnetic shielding material having MnBi, W, and at least one additional high Z material preferably has the following amounts of each component. In some approaches, a magnetic shielding product (e.g., article, device, structure, etc.) includes a part comprised of the magnetic shielding material, where the amounts of MnBi, W, and at least one additional material are based on the total weight of the magnetic shielding article.

In various approaches, the amount of manganese bismuth (MnBi) in a magnetic shielding article may be in a range of greater than 5 weight % (wt. %) to about 90 wt. % of a total weight of the magnetic shielding article. In some approaches, the amount of MnBi in a magnetic shielding material may be in a range of greater than 5 wt. % to about 90 wt. % of the total weight of the magnetic shielding material. In some approaches, the amount of MnBi may be in a range of greater than about 15 wt. % to about 50 wt. % of a total weight of the magnetic shielding material. In preferred approaches, the amount of MnBi may be in a range of greater than about 20 wt. % to about 50 wt. % of the total weight of the magnetic shielding material.

In various approaches, the amount of tungsten (W) may be in a range of greater than about 25 wt. % to about 94 wt. % of the total weight of the magnetic shielding article. In some approaches, the amount of W in a magnetic shielding material may be in a range of greater than about 25 wt. % to about 94 wt. % of the total weight of the magnetic shielding material. In one approach, the amount of W may be in a range of about 45 wt. % to about 70 wt. % of the total weight of the magnetic shielding material.

In various approaches, the amount of the at least one additional material in the magnetic shielding article may be in a range of greater than 0 wt. % to less than about 50 wt. % of the total weight percent of the magnetic shielding article. In some approaches, the amount of the at least one additional material in a magnetic shielding material may be in a range of greater than 0 wt. % to less than about 50 wt. % of the magnetic shielding material. Each of these ranges are preferred examples and the ranges for each MnBi, W, and the additional material may be higher or lower.

In some approaches, for example, and not meant to be limiting in any way, a series of ratios of NdFeB:MnBi may include: 50:50, 40:60, 30:70, etc. In one approach, a portion of the NdFeB with tungsten (W) may be replaced with MnBi. For example, and not meant to be limiting in any way a series of W:NdFeB:MnBi ratios may include: 50:25:25, 50:10:40, 40:25:35, etc. In one approach, the NdFeB may be replaced entirely by MnBi in the radiation shield material. In one approach, MnBi may be included with magnet material samarium cobalt, for example, $SmCo_5$, $Sm_2Co_{17}$, NdFeB, etc. In another approach, the MnBi material may include other rare earth elements.

According to one embodiment, the magnetic shielding material includes a radiation attenuation material (e.g., a radiation shielding material). In some approaches, the total amount of material for radiation shielding included in the magnetic shielding material may be less than the conventional amount of radiation shielding material included in a conventional radiation shield. For example, MnBi material provides both magnetic properties (Mn) and radiation shielding properties (Bi), thereby reducing the multiple materials needed for conventional magnetic radiation shielding material (W, NdFeB, etc.).

As illustrated in the schematic drawing of a magnetic shielding material 100 in part (a) of FIG. 1A, the material 102 includes a compositional gradient 103 in a z-direction perpendicular to an x-y plane. In various approaches described herein, the z-direction may be the direction of formation of the magnetic shielding material, perpendicular to a substrate on which formed, etc. In one approach, the z-direction of a magnetic shielding material formed in a mold may be the vertical direction perpendicular to the x-y plane, where the x-y plane may be defined as the base of the magnetic shielding material.

In one embodiment, a radiation shielding product includes a part comprising radiation shielding material. The radiation shielding material of the part includes MnBi and W and a plurality of layers having a defined thickness in a z-direction. Each layer extends along an x-y plane perpendicular to the z-direction. In some approaches, at least some of the plurality of layer may form a functional gradient in the z-direction and/or along the x-y plane. In preferred approaches, the part is comprised of a magnetic shielding material, and in exemplary approaches, the part is a permanent magnet. In one approach, the radiation shielding product may be comprised solely of radiation shielding material.

In some approaches, the amount of MnBi may be in a range of greater than 5 wt. % to about 100 wt. % of the total weight of the part. The amount of W may be in a range of greater than 0 wt. % to about 90 wt. % of the total weight of the part. The amount of the at least one additional material may be in a range of greater than 0 wt. % to less than about 50 wt. % of the total weight of the part.

In one approach, the plurality of layers 104 form a compositional gradient 103 may extend through the entire thickness th of the magnetic shielding material 100 in the vertical direction 105. The compositional gradient 103 may be defined by a first layer 106 including a first composition 108 of MnBi:W having a ratio of less than 100:0 and extending in a thickness th direction to an nth layer 110 above the first layer 106 including an nth composition 112 of MnBi:W having a ratio of greater than 0:100, where n may be defined as the number of layers in the compositional gradient of the magnetic shielding material. As shown in part (b), the compositional gradient 103 may include a first layer 106 having mostly MnBi that decreases in a complementary manner to an increase in amount of W to the nth layer 110 having mostly W.

In another approach, a magnetic shielding material includes a compositional gradient in an x and/or y direction along a horizontal plane perpendicular to a z-direction. As illustrated in the schematic drawing of a magnetic shielding material 120 in FIG. 1B, the structure 121 is formed of a material 122 having a compositional gradient 124 in a x-direction along a horizontal x-y plane perpendicular to a z-direction. In one approach, the compositional gradient 103 (as shown in part (b)) may extend through the entire width w of the magnetic shielding material 120 in the horizontal direction 123. The compositional gradient 124 may be defined by a first end 126 of the structure 121 including a first composition 128 of MnBi:W having a ratio of about 100:0 and extending in a width w direction to an opposite end 130 of the structure 121 in a x-direction, the opposite end 130 having an nth composition 132 of MnBi:W having a ratio of about 0:100, where n is the number of gradations of the material in an x-direction forming the compositional gradient.

In some approaches, the compositional gradient may comprise up to 100% of the material of the magnetic shielding material. In other approaches, the compositional gradient may comprise about up to about 80% of the material of the magnetic shielding material. In yet other approaches, the compositional gradient may comprise up to about 50% of the material of the magnetic shielding material.

In various approaches, the compositional gradient of the material is a gradient of radiation shielding material (e.g., radiation attenuation material), magnetic material, etc. In one approach, the compositional gradient may include a gradient of increasing radiation shielding material complementary to a gradient of decreasing magnetic material.

Figure 1C:
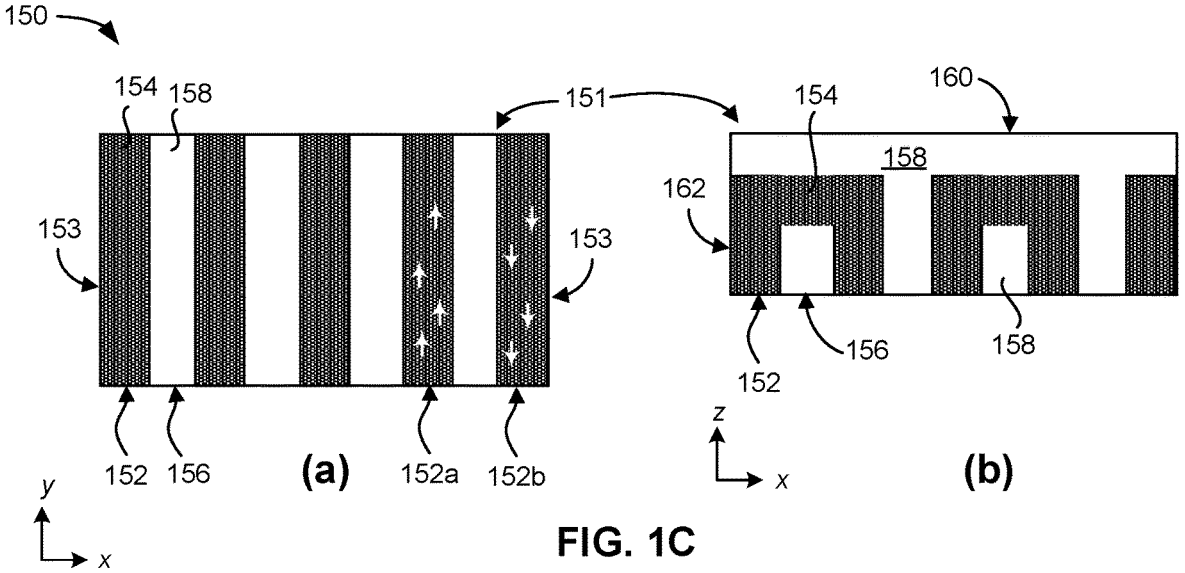
FIG. 1C is a schematic drawing of a magnetic shielding material, according to one embodiment. Part (a) is a bottom view of an x-y plane of the structure, and part (b) is a side view in the x-direction and the thickness in a z-direction.

In some approaches, the magnetic shielding material including manganese bismuth (MnBi) and tungsten (W) may be configured in a predefined pattern in an x-y plane perpendicular to a z-direction. As illustrated in FIG. 1C, a magnetic shielding material 150 includes a predefined pattern in an x-y plane defined by alternate portions of the MnBi and the W. In one approach, the predefined pattern may be defined by alternate portions of the manganese bismuth and the tungsten. Part (a) is a bottom view of the magnetic shielding material 150 that depicts the structure 151 in the x-y plane. As shown, a first portion 152 that may include end portions 153 of the magnetic shielding material 150. The first portion 152 may be comprised of magnetic material 154, e.g., MnBi. A second portion 156 is configured to be adjacent to, layered onto, coupled to, etc. the first portion 152. The second portion 156 may be configured to be positioned alternate to the first portion 152 in an x-direction along the x-y plane. The second portion may be comprised of a radiation shielding material 158, e.g., tungsten (W).

Part (b) is a schematic drawing of a side view of the magnet 150 that depicts the structure 151 in the x and z directions. As described herein, the z-direction is perpendicular to the x-y plane, and the z-direction may be the direction of formation of the magnet, perpendicular to a substrate on which formed, etc. The upper portion 160 of the structure 151 includes a radiation shielding material 158, e.g., tungsten (W). The two of the first portions 152 of the structure 151 may be connected forming an arch-like pattern 162 (in the x and z directions). The arch-like pattern 162 of the first portions 152 may be comprised of magnetic material 154, e.g., MnBi.

In various approaches, the magnetic pole direction for each portion of magnetic material may be configured to have a predefined pattern in the magnet structure. In some approaches, each portion of the MnBi has an opposite pole direction than the magnetic pole direction of a nearest portion of MnBi material. For example, looking to part (a) of FIG. 1C, one portion of MnBi 152*a* may have magnetic poles in one direction (small white arrows) and the nearest portion of MnBi 152*b* may have magnetic poles in the opposite direction (small white arrows).

Figure 2A:
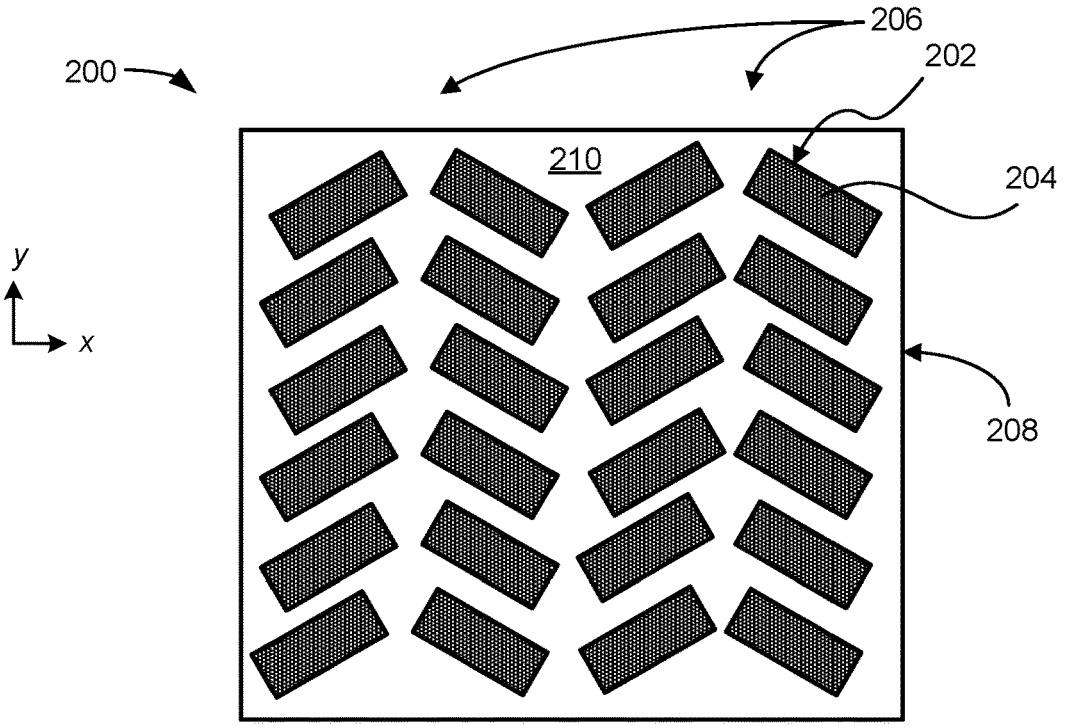
FIG. 2A is a schematic drawing of a patterned magnetic shielding material shown in the x-y plane, according to one embodiment.

In various approaches, a predefined pattern may be defined by portions of the magnetic material positioned in a pattern within a layer of the radiation shielding material. Preferably, the predefined pattern includes the radiation shielding material on the outermost portions of the layer and the magnetic material arranged in a pattern in the interior of the layer of the radiation shielding material. In one approach, the predefined pattern of the magnetic shielding material may be defined by an arrangement of portions of the MnBi positioned in a pattern within a layer of the tungsten (W). For example, as illustrated in FIG. 2A, a magnetic shielding material 200 includes portions 202 of MnBi 204 arranged in a herringbone pattern 206 within a layer 208 of tungsten (W) 210.

Figure 2B:
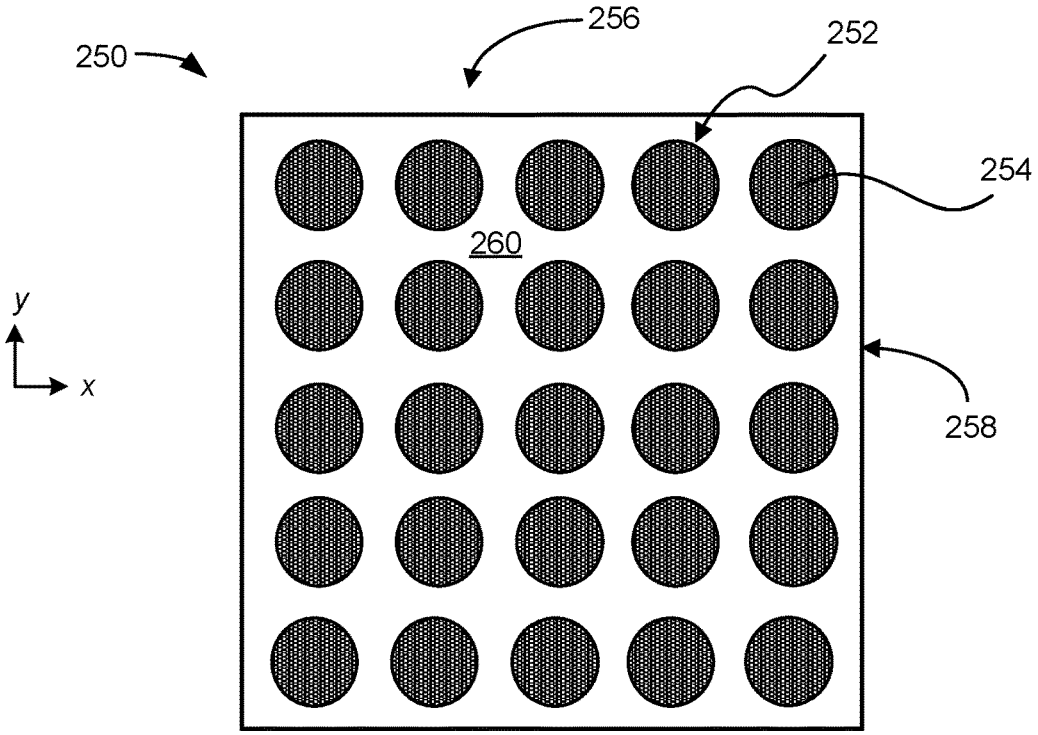
FIG. 2B is a schematic drawing of a patterned magnetic shielding material shown in the x-y plane, according to one embodiment.

In another example, as illustrated in FIG. 2B, a magnetic shielding material 250 includes portions 252 of MnBi 254 arranged in a rows-columns pattern 256 (e.g., cookies on a cookie sheet) within a layer 258 of tungsten (W) 260. In various approaches, the portions of MnBi may be a similar shape in the pattern, e.g., discs as in magnetic shielding material 250, bricks as in magnetic shielding material 200, squares, etc.

Figure 3:
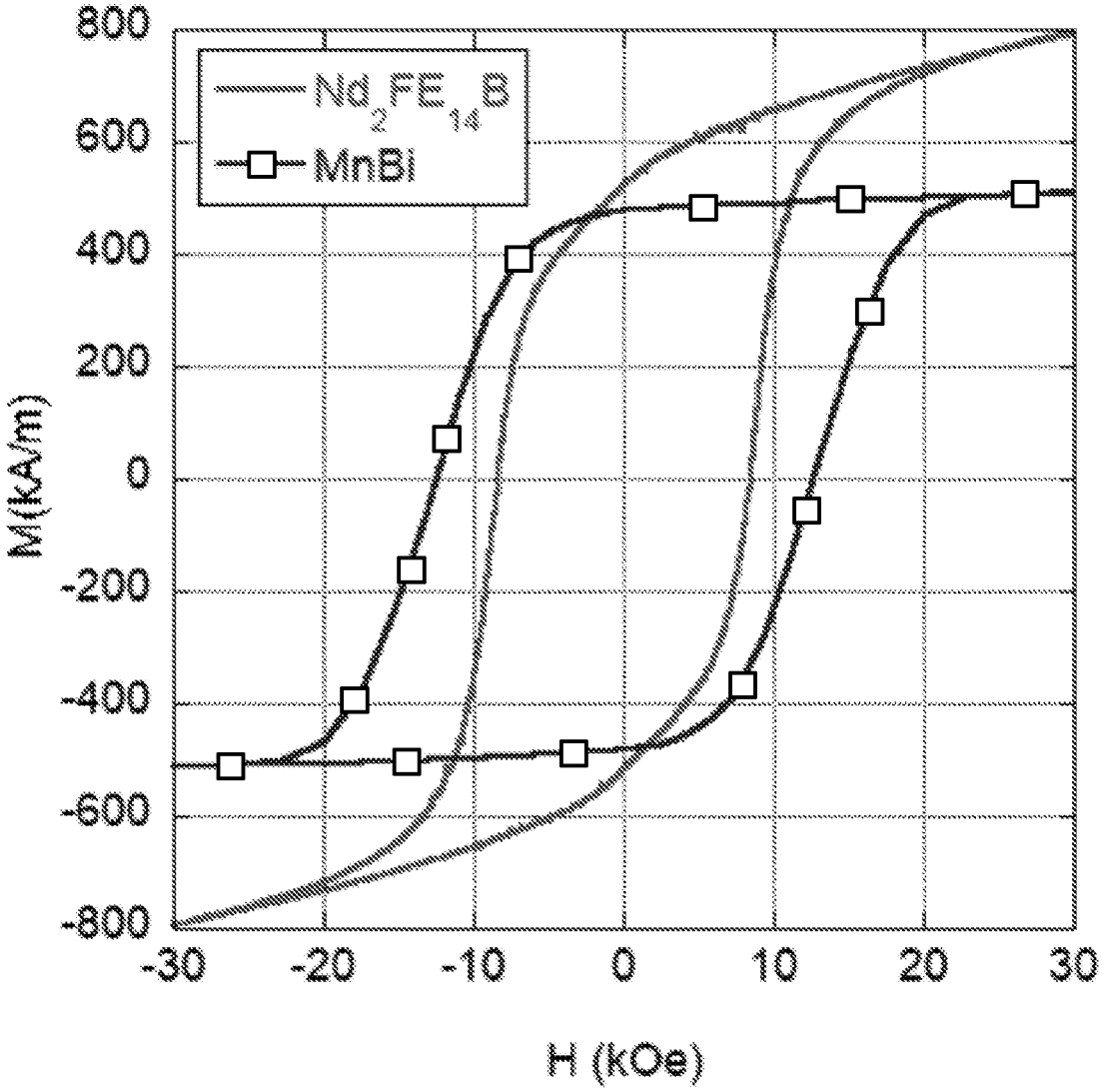
FIG. 3 is a magnetic hysteresis plot of neodymium material compared to MnBi material, according to one embodiment.

In various approaches, the magnetic shielding material including a material of MnBi and W is a permanent magnet. In some approaches, the remnant magnetism of the magnetic shielding material having MnBi material is similar to remnant magnetism of NdFeB material. In preferred approaches, a MnBi material has higher coercivity at a magnetism of zero compared to NdFeB material (as shown in FIG. 3, Experiments section). While a high coercivity is not essential to secure a magnet to a ferrous body, it is important to prevent the magnet from demagnetizing and losing its effectiveness over time. The important quantity for this process is the pull force which is the force required to pull a magnet away from a ferrous material and is generally proportional to the square of the magnetic remanence.

In some approaches, the magnetic shielding material has a coercivity greater than about 10 kOe at temperatures of up to about 300° C. MnBi has a higher Curie temperature (by ~50 degrees) than NdFeB, meaning that it will retain desired magnetic properties to higher temperatures than the traditional material. MnBi is unusual in that many of its magnetic properties initially improve with increasing temperature, and so a MnBi-based magnetic radiation shielding material offers the potential to be useful to a significantly higher temperature. This may become increasingly important as new nuclear reactor designs (Gen III, Gen IV) are expected to operate at higher temperatures.

In preferred approaches, the magnetic shielding material as described herein having less radiation shielding material than conventional radiation shields demonstrates a similar degree of radiation shielding from gamma radiation. For example, at low gamma radiation energies, a half-value thickness of MnBi is 25% less compared to the half-value thickness of conventional shield of NdFeB material, and at higher gamma radiation energies, a half-value thickness of MnBi may be as much as 40% less than the half-value thickness of a conventional shield of NdFeB.

According to various embodiments, magnets, parts, radiation shielding material, etc. as described herein may be fabricated using methods generally understood by one skilled in the art of magnet fabrication and radiation shielding fabrication, and processes include layering of magnetic material and radiation shielding material in a predefined pattern.

Following formation of the layer, structure, etc. a magnetic field may be applied to the layer, structure, etc. to align the magnetic poles of the magnetic material. In some approaches, a magnetic field may be applied to each layer before maturation, sintering, etc. of the magnet material to create a gradient.

In some approaches, during formation of the layers of the magnetic shielding material, a magnetic field may be applied according to the pattern of MnBi in the layer. The performance of the magnetic shielding material may be improved by using the applied magnetic field to selectively pull, arrange, relocate, etc. the MnBi to a location that is near a surface of a preferred side of the material.

Experiments

Magnetic properties of MnBi. FIG. 3 is a magnetic hysteresis plot of an applied magnetic field (x-axis, H in kilo Oersted, kOe) versus magnetism, M (y-axis, in kA/m) of neodymium material ($Nd_2Fe_{14}B$) (line) compared to MnBi material (□). As illustrated in the plot, at zero external magnetic field strength, when H is 0, the remnant magnetism (or remanence) of the MnBi material is similar to that of the neodymium material.

The coercivity of the material is shown when magnetization is zero (the curve crosses the x-axis). The MnBi has a coercivity of approximately 12 kOe whereas this particular neodymium material has a coercivity of approximately 8 kOe. According to this plot, the higher the coercivity the less easy the material is to demagnetize.

Figure 4:
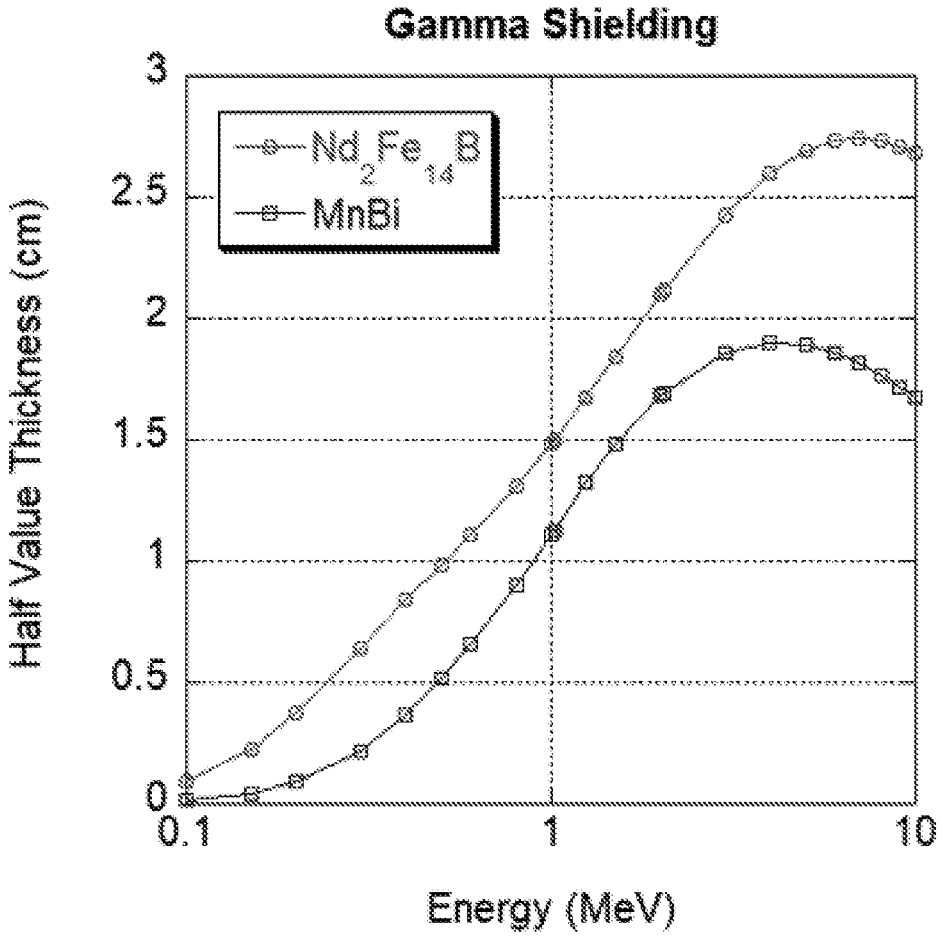
FIG. 4 is a plot comparing the gamma radiation shielding properties of MnBi compared to neodymium material, according to one embodiment.

Radiation screening properties of MnBi. FIG. 4 is a plot of the gamma radiation Energy (mega electron volts, MeV) (x-axis) versus half-value thickness (cm) of the material (y-axis). Comparing the half-value thickness of the neodymium material (o) to the MnBi material (□), significantly less MnBi is needed to attenuate half of the gamma radiation in comparison to the NdFeB material, thereby demonstrating similar degree of shielding with less material. For example, at a gamma radiation energy level of 1 MeV, the half-value thickness of MnBi is approximately 1.1 cm, whereas the half-value thickness of the neodymium material is 1.5 cm. Moreover, at the higher energy level of 10 MeV, the difference in half-value thickness is greater, with MnBi at approximately 1.6 cm and the neodymium material at 2.6 cm. The MnBi provides significant gamma ray shielding with less material than the neodymium material and would translate to a significant cost savings if MnBi were to replace the neodymium material in the radiation shielding product.

Uses

Potential uses for this material would be for portable and/or removable shielding in nuclear power plants and near other nuclear reactors. Additional applications could include nuclear waste storage areas, as well as synchrotrons and accelerators where there is potential exposure to gamma, x-ray, or neutron radiation. Other applications include radiographic non-destructive testing where gamma radiation is used to look for cracks and other indications of fatigue in applications from jet engine turbines to amusement park rides.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments but should be defined only in accordance with the following claims and their equivalents.

What is claimed is:

1. A magnetic shielding material comprising:

a material comprising manganese bismuth (MnBi) and tungsten (W), wherein a ratio of MnBi:W by weight is in a range of 50:50 to about 70:30, wherein the magnetic shielding material comprises a plurality of first portions and a plurality of second portions, the first portions of the material are comprised of the manganese bismuth and the second portions of the material are comprised of the tungsten, the second portions being separate from the first portions, wherein the first and second portions are positioned in the material according to an arrangement defined by a predefined pattern of the first and second portions in an x-y plane.

2. The magnetic shielding material as recited in claim 1, further comprising at least one additional material combined with the material, wherein the at least one additional material is selected from the group consisting of: neodymium iron boron, tantalum, lead, boron carbide, lithium, lithium compounds, iron, stainless steel, and samarium cobalt.

3. The magnetic shielding material as recited in claim 2, wherein an amount of manganese bismuth (MnBi) is in a range of greater than 5 weight percent to about 90 weight percent of the total weight of the magnetic shielding material, wherein an amount of tungsten (W) is in a range of greater than about 25 weight percent to about 94 weight percent of the total weight of the magnetic shielding material, wherein an amount of the at least one additional material is in a range of greater than 0 weight percent to less than about 50 weight percent of the total weight of the magnetic shielding material.

4. The magnetic shielding material as recited in claim 2, wherein the samarium cobalt material is present, wherein the samarium cobalt material is $SmCo_5$ and/or $Sm_2Co_{17}$.

5. The magnetic shielding material as recited in claim 1, wherein the material has a coercivity greater than about 10 kiloOersteds at temperatures up to 300 degrees Celsius.

6. The magnetic shielding material as recited in claim 1, wherein the material includes a radiation attenuation material.

7. The magnetic shielding material as recited in claim 6, wherein the radiation attenuation material is configured to absorb at least one radiation energy selected from the group consisting of: gamma rays and neutrons.

8. The magnetic shielding material as recited in claim 1, wherein the predefined pattern is selected from the group consisting of: an arch pattern, a herringbone pattern, and a rows-columns pattern.

9. The magnetic shielding material as recited in claim 8, wherein the predefined pattern comprises the first portion present as discrete portions within a continuous layer of tungsten extending along the x-y plane.

10. The magnetic shielding material as recited in claim 1, wherein the predefined pattern comprises an arrangement whereby the second portion is positioned at outermost locations in the x-y plane and the first portion is positioned at interior locations of the x-y plane.

11. The magnetic shielding material as recited in claim 1, wherein the predefined pattern extends the entire length of the x-y plane of the material.

12. The magnetic shielding material as recited in claim 11, wherein the predefined pattern is defined by alternate portions of the manganese bismuth and the tungsten.

13. The magnetic shielding material as recited in claim 12, wherein each portion of the manganese bismuth has an opposite magnetic pole direction than the magnetic pole direction of a nearest portion of the manganese bismuth.

14. The magnetic shielding material as recited in claim 11, wherein the predefined pattern is defined by portions of manganese bismuth arranged in a pattern within a layer of the tungsten.

15. The magnetic shielding material as recited in claim 1, wherein the material is a permanent magnet.

16. A radiation shielding product, the product comprising:

a part comprising a combination of manganese bismuth (MnBi) and tungsten (W); and at least three layers having a defined thickness in a z-direction, wherein each layer extends along an x-y plane perpendicular to the z-direction, wherein at least some of the layers form a functional gradient in the z-direction and/or along the x-y plane, wherein the functional gradient is defined by a first of the layers comprising a ratio of MnBi:W being less than 100:0 by weight of the combination of MnBi and W and at least one nth one of the layers above the first layer comprising a ratio of MnBi:W greater than 0:100 by weight of the combination of MnBi and W, wherein the functional gradient is further defined by each nth layer having a predefined increase in concentration of W and a corresponding decrease in concentration of Mn relative to the layer immediately thereunder.

17. The radiation shielding product as recited in claim 16, wherein the part is a permanent magnet.

18. The radiation shielding product as recited in claim 16, wherein the part further comprises at least one additional material combined with the manganese bismuth and the tungsten, wherein the at least one additional material is selected from the group consisting of: neodymium iron boron, tantalum, lead, boron carbide, lithium, lithium compounds, iron, stainless steel, and samarium cobalt.

19. The radiation shielding product as recited in claim 18, wherein an amount of manganese bismuth (MnBi) is in a range of greater than about 5 weight percent to about 100 weight percent of the total weight of the part, wherein an amount of tungsten (W) is in a range of greater than about 0 weight percent to about 90 weight percent of the total weight of the part, wherein an amount of the at least one additional material is in a range of greater than 0 weight percent to less than about 50 weight percent of the total weight of the part.

20. The radiation shielding product as recited in claim 16, wherein the functional gradient is a gradient of radiation shielding material and magnetic material.

* * * * *